United States Patent [19]

Wolpa

[11] 4,167,824

[45] Sep. 18, 1979

[54] INNER SOLES FOR SHOES

[76] Inventor: Mark E. Wolpa, 400 40th St., Oakland, Calif. 94609

[21] Appl. No.: 888,282

[22] Filed: Mar. 20, 1978

[51] Int. Cl.[2] ..... A43B 13/40

[52] U.S. Cl. ..... 36/44; 428/315

[58] Field of Search ..... 36/44, 43; 428/310, 428/311, 315; 128/595

[56] References Cited

U.S. PATENT DOCUMENTS

| | | | |
|---|---|---|---|
| 2,256,483 | 9/1941 | Johnston | 36/44 X |
| 3,449,844 | 6/1969 | Spence | 36/44 |
| 3,730,169 | 5/1973 | Fiber | 36/44 X |
| 3,954,537 | 5/1976 | Alfter et al. | 428/315 X |
| 4,054,706 | 10/1977 | Shapiro | 36/44 |
| 4,060,280 | 11/1977 | Van Loo | 428/315 X |
| 4,062,131 | 12/1977 | Hsiung | 36/44 |

FOREIGN PATENT DOCUMENTS

| | | | |
|---|---|---|---|
| 1415852 | 11/1975 | United Kingdom | 428/310 |

*Primary Examiner*—James Kee Chi

*Attorney, Agent, or Firm*—Limbach, Limbach & Sutton

[57] ABSTRACT

An inner sole insert is disclosed which comprises an open cell foam base capable of conforming to and substantially retaining the shape of compressive forces applied thereto, an elastic closed cell foam layer having a maximum compression set of less than 50% and a stretch fabric bonded to one face of the closed cell foam layer. The inner sole can be used in athletic shoes and other environments for substantially reducing blisters and callouses and can accommodate the individual foot by molding thereto.

7 Claims, 2 Drawing Figures

INNER SOLES FOR SHOES

BACKGROUND OF THE INVENTION

It is commonly known that the participation in sporting activities such as basketball, tennis and the like which require running and instantaneous changes of direction can cause the athletic participant to develop blisters, callouses and other sores on the skin of the feet. This is primarily due to frictional shear forces between the skin layers. Foot blisters are also very common among athletes because of the excessive friction on the sole of the athletes foot at the maximum force points which are commonly under the metatarsal and under the large toe. Attempts have been made to overcome this problem through the use of pads and the like, commonly referred to as inner soles, placed in the athletes shoes. While the pads provide a horizontal cushion they do not eliminate transverse longitudinal friction on the sole of the foot which causes the blisters. Another attempt to solve this problem was proposed by Spence in U.S. Pat. No. 3,449,844. In that patent, an inner sole was taught comprising a closed cell foam such as neoprene which was covered with a two-way stretch fabric such as nylon. Although the elastic closed cell foam inner sole of U.S. Pat. No. 3,449,844 adequately accomplished the goal of reducing friction between the inner sole and skin resulting in decreased blistering and callousing, the inner sole nevertheless is not an ideal solution to improved comfort and wearability of shoes primarily intended for use in stress situations such as athletic events. It was found that an inner sole using only a closed cell foam base and fabric cover fails to possess the desired cushioning effect necessary in athletic use. Furthermore, a neoprene or equivalent material does not mold to the individual foot and maintain the contour of the foot as does the open cell material as taught herein.

It is thus an object of the present invention to produce an inner sole insert which eliminates all of the drawbacks outlined above.

It is the further object of the present invention to produce an inner sole insert which eliminates blistering and callouses due primarily to friction between the inner sole and the foot of the user.

It is yet another object of the present invention to produce an inner sole insert which cushions the foot and conforms to the shape of the foot and maintains that confirmation indefinitely.

Figure 1:
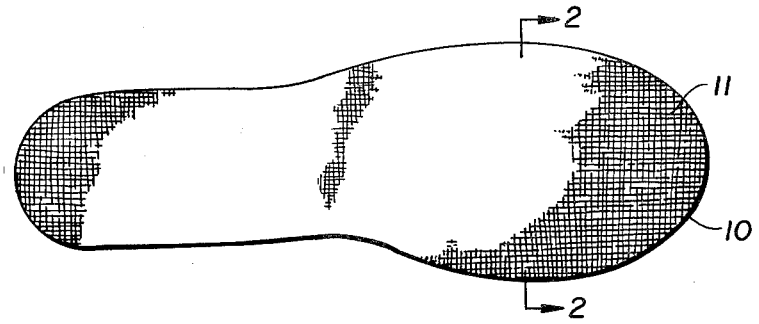
FIG. 1 is a plan elevation view of an inner sole of the present invention.
Figure 2:
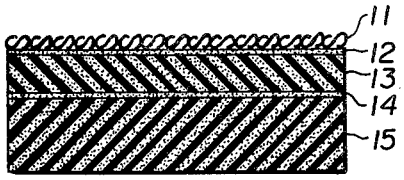
FIG. 2 is a sectional view taken along line 2—2 of FIG. 1.

Referring now more particularly to the drawings, inner sole 10 of the present invention is comprised of a top layer 11 comprised of stretch fabric which is bonded via rubbery adhesive to an elastic closed-cell foam layer 13. The elastic closed-cell foam layer 13 is in turn attached by, for example, rubbery adhesive layer 14 to an open-cell foam base 15 capable of conforming to and substantially retaining the shape of compressive forces applied thereto.

SUMMARY OF THE INVENTION

The present invention comprises an inner sole insert possessing an open cell foam base capable of conforming to and substantially retaining the shape of compressive forces applied thereto, an elastic closed cell foam layer having a maximum compressive set of less than 50% and a two-way linear elongation which allows one face of said closed cell foam layer to shift laterally ⅛ to ½ inch with respect to its other face when a lateral force is applied to said one face and a stretch fabric bonded to one face of said closed cell foam layer with a rubber adhesive.

The closed cell foam is a foam with individual cells which are out of communication from each other such as neoprene, closed cell rubber, polyvinyl chloride, rubber laytex, vinyl foam, or any other foamed rubber-like material having similar characteristics. In addition to being of a closed cell construction, the closed cell foam layer preferably has a maximum compression set less than 50% and most preferably less than 25% and also has a two-way linear elongation of ¼ to ½ inch. This layer is preferably used in a thickness of approximately 1/16 to 3/16 inches. A complete description of the physical properties of the closed cell layer can be found in U.S. Pat. No. 3,449,844 and the disclosure of this patent is incorporated by reference herein.

As stated previously, the open cell foam base is a material which provides not only a cushioning effect to the inner sole but also is a material which can be compressed and caused to retain the shape of the compressive force thereby allowing the individual foot to adopt to its environment unlike other materials such as neoprene alone which being closed cell will not allow the foot to adopt to its environment. Air is expelled from the open cell structure selectively depending upon the compressive forces. Constant or sustained selective pressure causes the open cell foam base to "mold" to the foot of the wearer providing an extremely comfortable inner sole which, after repeated use, becomes custom fit to the foot of the wearer.

The open cell foam base is a material selected from the group consisting of foamed cross-linked polyethylene and ethylene vinyl acetate and preferably used as the foam base in approximately ⅛ to ½ inches thick and available from Apex Company of Englewood, New Jersey.

To the elastic closed cell foam layer is bonded a two-way stretch fabric which is used to provide a relatively smooth surface to the foot of the wearer of the inner sole of the present invention. Of importance is the fact that the fabric has a lower coefficient of friction than the elastic closed cell foam layer and that it be capable of two way yield or stretch so that motion which is imparted to the fabric is transferred to the elastic closed cell foam layer. As taught in U.S. Pat. No. 3,449,844, the best example of a fabric of this type is stretch nylon.

The various layers of the present invention can be bonded to one another with a rubber adhesive so that the elastic characteristics of the various layers are not destroyed upon bonding.

The inner sole insert of the present invention represents a unique device which can be used to prevent blisters and callouses and protect the human foot from micro trauma in athletic endeavors. It is well known that the foot undergoes various compensatory actions to dissipate stress encountered in the participation of athletic endeavors. Friction occuring during foot rotation as well as the jumping and pounding received by the individual foot leads to various problems such as blisters and callous formation as well as direct trauma to the foot and leg. Prior art devices employing materials such as neoprene help to eliminate these problems by reducing friction between the foot and the inner sole but do not completely eliminate the problem because the inner sole never conforms to the shape of the foot to retain the shape to form a permanent contour, thereby supporting and protecting the foot due to this unique conformation.

What is claimed is:

1. An inner sole insert which comprises (1) an open cell foam base capable of conforming to and substantially retaining the shape of compressive forces applied thereto, (2) an elastic closed cell foam layer having a maximum compression set of less than 50 percent and a two-way linear elongation which allows one face of said closed cell foam layer to shift laterally ⅛ to ½ inch with respect to the other face when a lateral force is applied to said one face, and (3) a stretch fabric bonded to one face of said closed cell foam layer with a rubbery adhesive.

2. The inner sole insert of claim 1 wherein said open cell foam base is selected from the group consisting of polyethylene and ethylene vinyl acetate.

3. The inner sole insert of claim 1 wherein said closed cell foam layer is neoprene.

4. The inner sole insert of claim 1 wherein said stretch fabric is elastic nylon.

5. The inner sole insert of claim 2 wherein said open cell foam base is foamed cross-linked polyethylene.

6. The inner sole insert of claim 1 wherein said open cell foam base is approximately ⅛ to ½ inches thick.

7. The inner sole insert of claim 1 wherein said cell foam layer is approximately 1/16 to 3/16 inches thick.

* * * * *